US011479383B2

(12) United States Patent
Konrad

(10) Patent No.: US 11,479,383 B2
(45) Date of Patent: Oct. 25, 2022

(54) BOX PROVIDED WITH TAMPER EVIDENT MEANS

(71) Applicant: INTERSTATE RESOURCES INC., Atlanta, GA (US)

(72) Inventor: Karl Konrad, Jefferson, MA (US)

(73) Assignee: INTERSTATE RESOURCES INC., Atlanta, GA (US)

( * ) Notice: Subject to any disclaimer, the term of this patent is extended or adjusted under 35 U.S.C. 154(b) by 0 days.

(21) Appl. No.: 17/318,368

(22) Filed: May 12, 2021

(65) Prior Publication Data

US 2021/0354874 A1 Nov. 18, 2021

Related U.S. Application Data

(60) Provisional application No. 63/023,991, filed on May 13, 2020.

(51) Int. Cl.
*B65D 5/42* (2006.01)
*B65D 5/68* (2006.01)
*B65D 5/02* (2006.01)

(52) U.S. Cl.
CPC ..... *B65D 5/4212* (2013.01); *B65D 5/0227* (2013.01); *B65D 5/4266* (2013.01); *B65D 5/68* (2013.01); *B65D 2401/05* (2020.05)

(58) Field of Classification Search
CPC ..... B65D 5/643; B65D 5/68; B65D 5/685; B65D 2401/00; B65D 2401/02; B65D 2401/50; B65D 55/02
USPC .... 229/102, 125.13, 125.19, 125.21–125.23, 229/125.37–125.38
See application file for complete search history.

(56) References Cited

U.S. PATENT DOCUMENTS 636,302 A * 11/1899 Vogle ..... B65D 5/0254 229/102
749,125 A * 1/1904 Buckton ..... B65D 5/3642 229/117.07
2,395,363 A * 2/1946 Williams ..... B65D 5/685 229/125.28
4,101,052 A * 7/1978 Dove ..... B65D 5/0005 229/101
4,516,718 A 5/1985 Forbes, Jr.
4,927,074 A * 5/1990 LaRue ..... B65D 5/42 229/102
5,332,088 A * 7/1994 Schreiber ..... B65D 5/4608 206/774

(Continued)

*Primary Examiner* — Nathan J Newhouse
*Assistant Examiner* — Phillip D Schmidt
(74) *Attorney, Agent, or Firm* — Armstrong Teasdale LLP

(57) ABSTRACT

A box has a lower container and a cover. The lower container has a rectangular bottom wall, two first side walls opposite to each other and two second side walls opposite to each other. The cover has a rectangular main wall opposite to the bottom wall, two third side walls opposite to each other and two fourth side walls opposite to each other. The third side walls are adjacent and outside an upper portion of the first side walls, respectively. The fourth side walls are adjacent and outside an upper portion of the second side walls, respectively. A respective first tab with a through-hole protrudes downwards from a lower edge of both third side walls. A respective second tab with a through-hole is cut in both first side walls and has a side attached to the respective first side wall. Tamper evident means pass through respective couples of first and second tabs of adjacent third and first walls.

10 Claims, 3 Drawing Sheets

(56) References Cited

U.S. PATENT DOCUMENTS

| | | | | |
|---|---|---|---|---|
| 5,779,129 | A * | 7/1998 | Herbst | B65D 5/68 229/125.19 |
| 2014/0069059 | A1* | 3/2014 | Scott | B65D 5/4608 53/416 |
| 2021/0002020 | A1* | 1/2021 | Pizarro Del Rio | B65D 5/68 |

* cited by examiner

BOX PROVIDED WITH TAMPER EVIDENT MEANS

CROSS REFERENCE TO RELATED APPLICATION

This application claims priority to and the benefit of U.S. Provisional Patent Application No. 63/023,991, filed May 13, 2020, the contents of which are incorporated by reference in its entirety.

FIELD OF THE INVENTION

The present invention relates to a box formed by a lower container and a cover.

BACKGROUND OF THE INVENTION

U.S. Pat. No. 4,927,074 discloses a cardboard box comprising a body and a lid with nylon cable ties threaded through grommet holes in the lid and handle holes in the body.

U.S. Pat. No. 4,516,718 discloses a carton comprising a combination lid and tray with locking means for securing the lid and tray when the carton is closed.

SUMMARY OF THE INVENTION

One object of the present invention is to provide a box formed by a lower container and a cover, which is improved in respect of the ones of the prior art, in particular as far as the provision of evidence of box opening is concerned.

According to the present invention, this object is achieved by means of a box formed by a lower container and a cover, wherein the lower container has a substantially rectangular bottom wall, two first side walls opposite to each other and two second side walls opposite to each other, wherein the cover has a substantially rectangular main wall opposite to said bottom wall, two third side walls opposite to each other and two fourth side walls opposite to each other, the third side walls being adjacent and outside an upper portion of said first side walls, respectively, and the fourth side walls being adjacent and outside an upper portion of said second side walls, respectively, and wherein a first tab with a through-hole protrude downwards from a lower edge of both third side walls, a second tab with a through-hole is cut in both first side walls and has a side which is attached to the respective first side wall, and tamper evident means pass through respective couples of first and second tabs of adjacent third and first walls.

Any reference in the present specification and claims to "rectangular" includes the particular case of "square", unless explicitly differently specified.

An advantage of the box of the present invention is that it allows that the tamper evident means are installed when the box is closed with the cover on the lower container, without requiring any lifting of the cover.

An additional advantage of the box of the present invention is that the tamper evident means can be installed only if actually needed, so that the functionality of the box is unaffected, when such tamper evident means are not installed.

BRIEF DESCRIPTION OF THE DRAWINGS

Further advantages and features of the present invention will be apparent from the following detailed description, given by way of non-limiting example with reference to the appended drawings, wherein.

DETAILED DESCRIPTION

Figure 1:
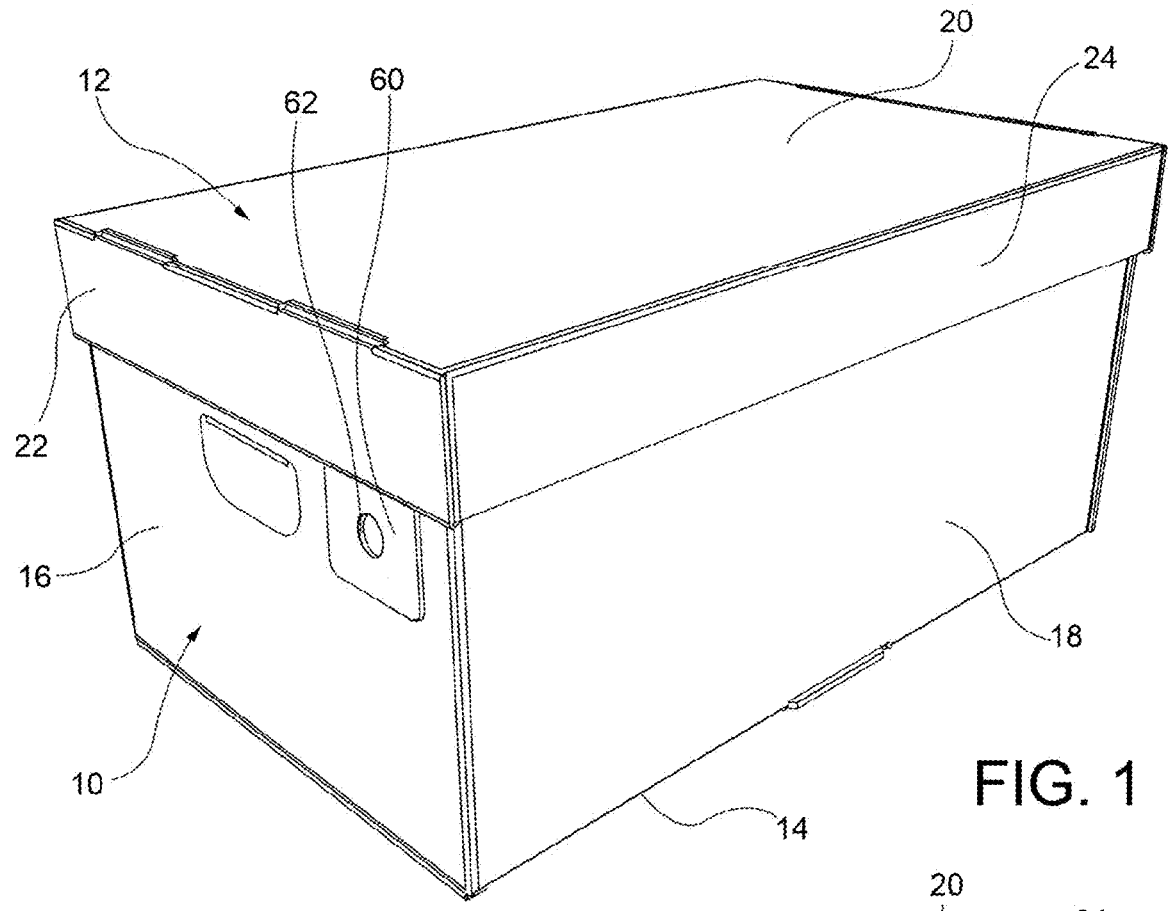
FIG. 1 is a perspective view of a box according to the present invention.

A substantially parallelepiped box (FIG. 1) is formed by a lower container or body 10 and a cover or lid 12 superposed on the lower container 10.

The lower container 10 has a substantially rectangular bottom wall 14, two first side walls 16 opposite to each other and two second side walls 18 opposite to each other. The cover 12 has a substantially rectangular main wall 20 facing or opposite to the bottom wall 14 of the container 10, two third side walls 22 opposite to each other and two fourth side walls 24 opposite to each other. The third side walls 22 are adjacent and outside an upper portion of the first side walls 16, respectively, and the fourth side walls 24 are adjacent and outside an upper portion of the second side walls 18.

Figure 2:
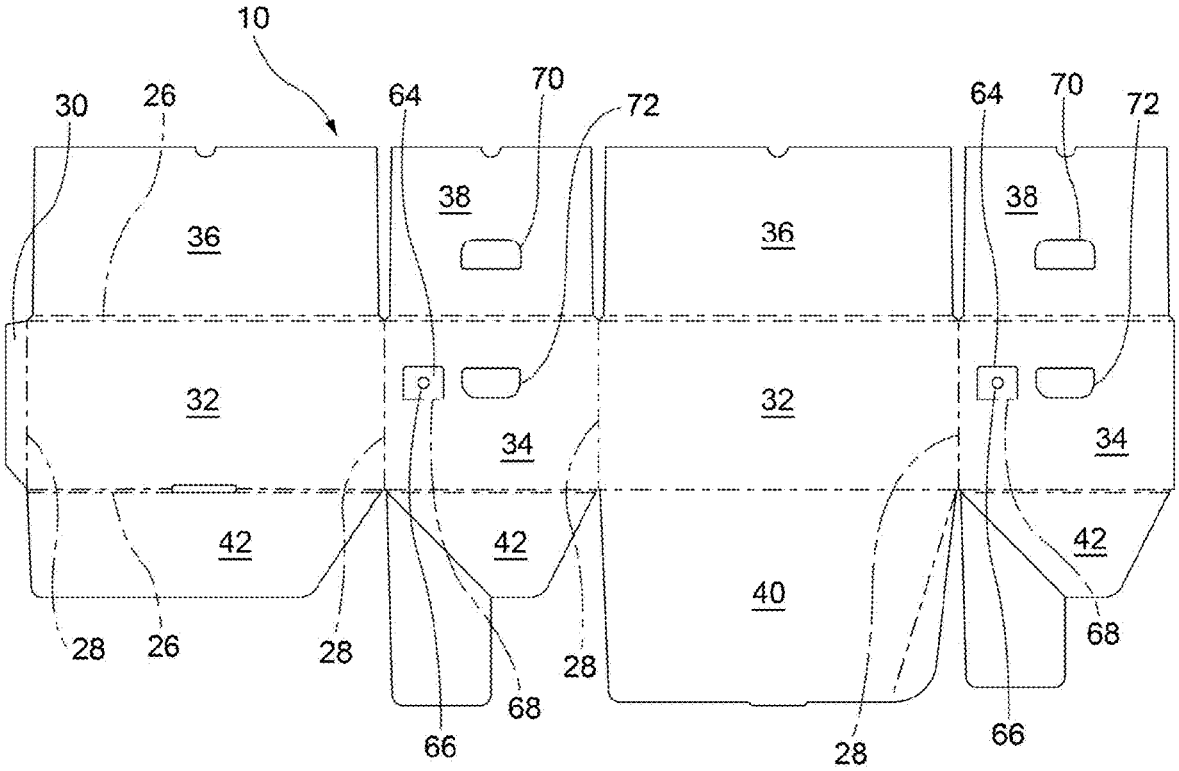
FIG. 2 is a plan view of a blank usable for producing a lower container of the box according to the invention of FIG. 1.
Figure 3:
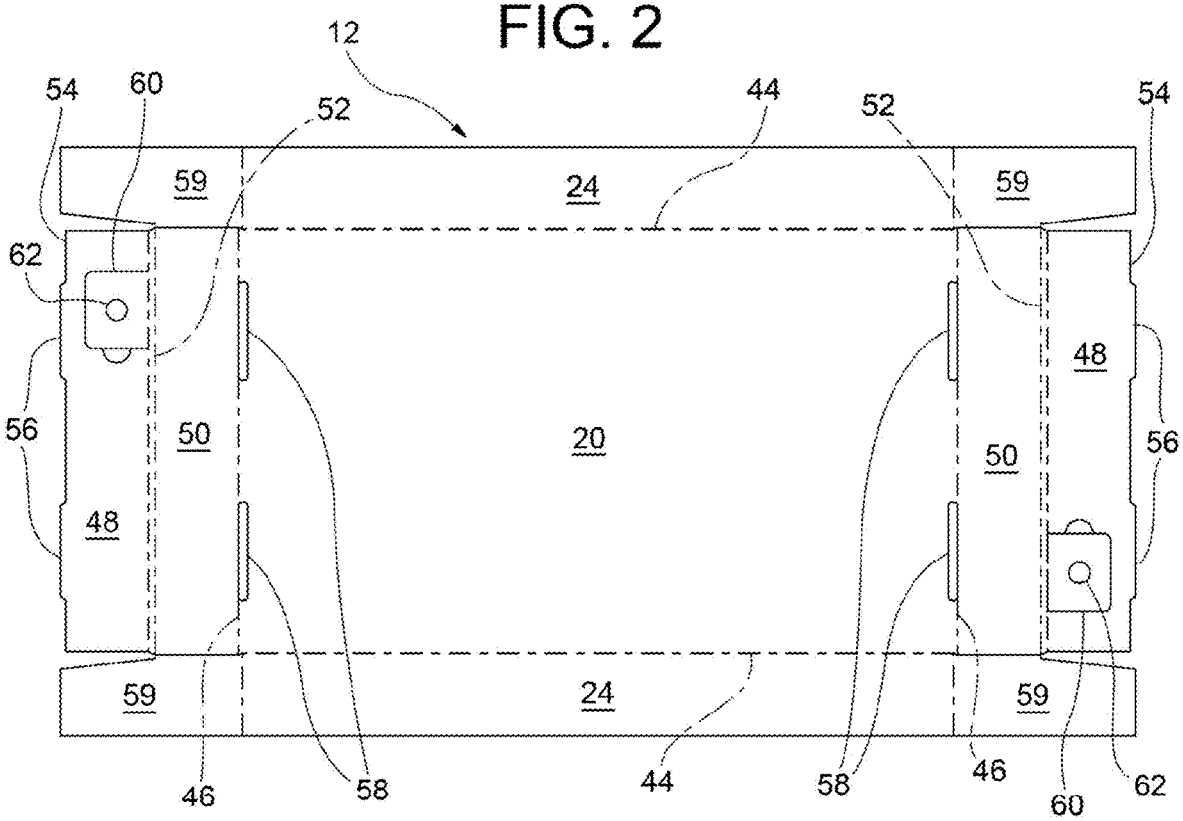
FIG. 3 is a plan view of a blank usable for producing a cover of the box according to the invention of FIG. 1, FIGS. 4 to 6 are perspective views of successive steps of an installation procedure of tamper evident means on the box of FIG. 1.

Such general arrangement of the box is well-known and the lower container 10 and cover 12 are obtainable by conventionally folding and gluing respective blanks of cardboard which are illustrated in FIGS. 2 and 3, respectively.

The blank (see FIG. 2) for producing the lower container 10 has two first parallel crease lines 26 and four second crease lines 28 parallel to each other and orthogonal to the first parallel crease lines 26 which define a central series of a closure tongue 30, and external panels 32 of the second side walls 16 alternated to external panels 34 of the first side walls 16, a first lateral series of internal panels 36 of the second side walls alternated to internal panels 38 of the first side walls 16, and a second lateral series of reinforcing flaps 42 of the bottom wall 14 and a main panel 40 of the bottom wall 14. The panels and flaps of each of the first and second lateral series are separated from the adjacent panels/flaps and connected solely to the adjacent panel 32, 34 of the central series.

The blank (see FIG. 3) for producing the cover 12 has crease lines which individuate the main rectangular wall 20, whose perimeter has two long opposite sides 44 and two short opposite sides 46, the two third side walls 22 being adjacent to the two short sides 46, respectively, and the two fourth side walls 24 being adjacent to the two long sides 44, respectively.

Each third side wall 22 consists of an internal flap 48 and an external flap 50 delimited by a double crease line 52 parallel to the short sides 46, wherein the definition "external" and "internal" are referred to the erected configuration of the cover 12. A free edge 54 of each internal flap 48 has two protrusions 56 suitable for insertion into respective recesses 58 adjacent to the short sides 46.

The fourth side walls 24 have at both ends respective wings 59 which are attached thereto by a prolongation of the crease lines defining the short sides 46.

According to the invention, a rectangular first tab 60 with a central circular through-hole 62 is cut in each internal flap 48 of the third side walls 22 of the cover 12 and has a side attached to the respective external flap 50 by the double crease line 52. Likewise, a rectangular second tab 64 with a central circular through-hole 66 is cut in each external panel 34 of the first side walls 16 and has a lower side attached to the external panel 34 by a crease line 68.

Each internal panel 38 of the first side walls 16 has an opening 70 for box handling and each external panel 34 of the first side walls 16 has a foldable tongue 72 which is aligned to the corresponding opening 70 in the erected configuration of the lower container 10 and has the same shape as the corresponding opening 70.

Once the lower container 10 and the cover 12 are in the erected configuration (FIG. 1), the first and second side walls 16, 18 of the lower container 10 are formed by the respective external 34, 32 and internal 38, 36 panels folded adjacent to each other. Likewise, even the third side walls 22 of the cover 12 are formed by the respective external and internal flaps 50, 48 folded adjacent to each other. The third side walls 22 are further reinforced due to the fact that the two protrusions 56 of the free edge 54 of each internal flap 48 are inserted into the respective recesses 58 adjacent to the crease line defining the respective short side 46 and to the fact that the wings 59 of the fourth side walls 24 are inserted between the facing internal and external flaps 48, 50.

In the normal erected configuration (FIG. 1), the first tabs 60 are not folded about the double crease 52 line together with the remaining portion of the respective internal flap 48, so that they protrude downwards from a lower edge of the respective third side 22 and face the respective second tabs 64 of the first walls 16 of the lower container 10, so that the respective through-holes 62, 66 are fully aligned.

Advantageously, the two couples of first and second tabs 60, 64 of adjacent third and first walls 22 16 are oppositely located in respect of a central longitudinal axis, or median region of the box.

Figure 4:
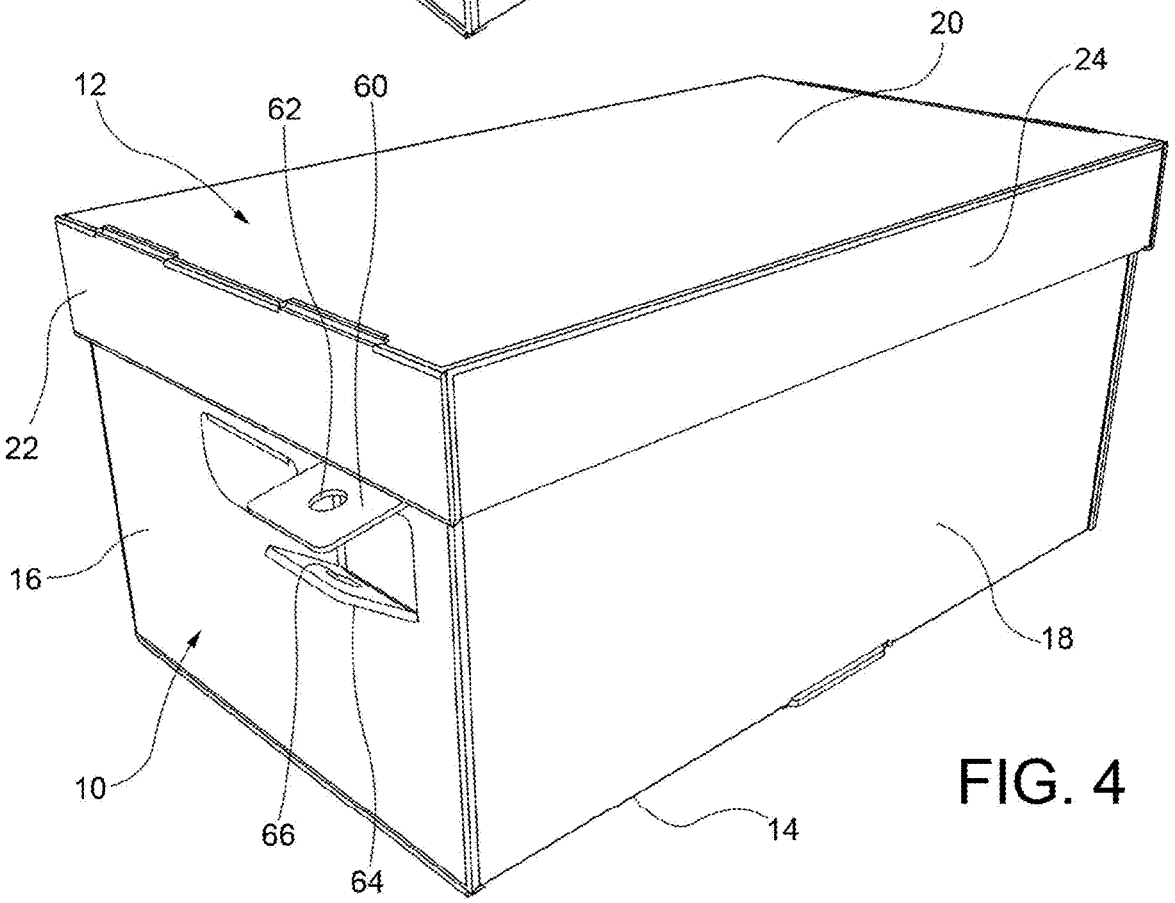
Figure 5:
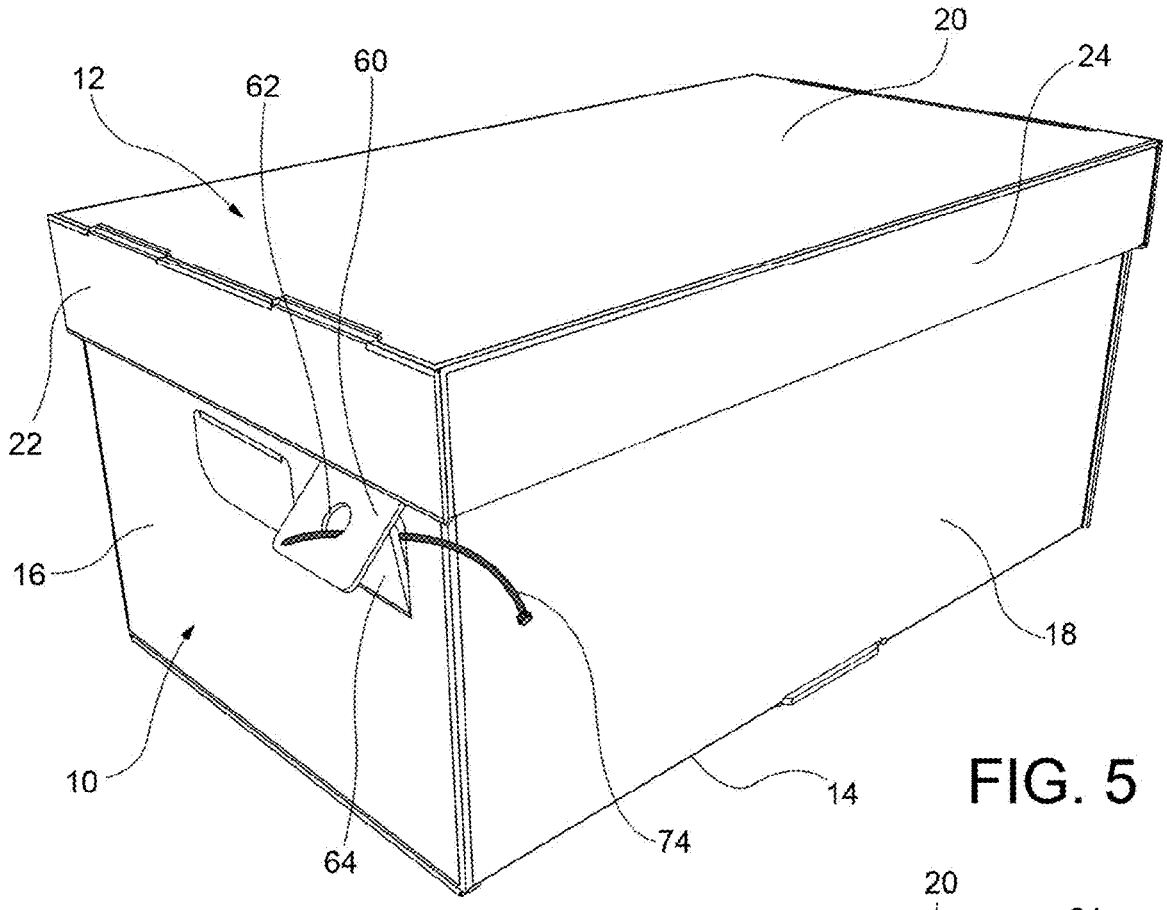
Figure 6:
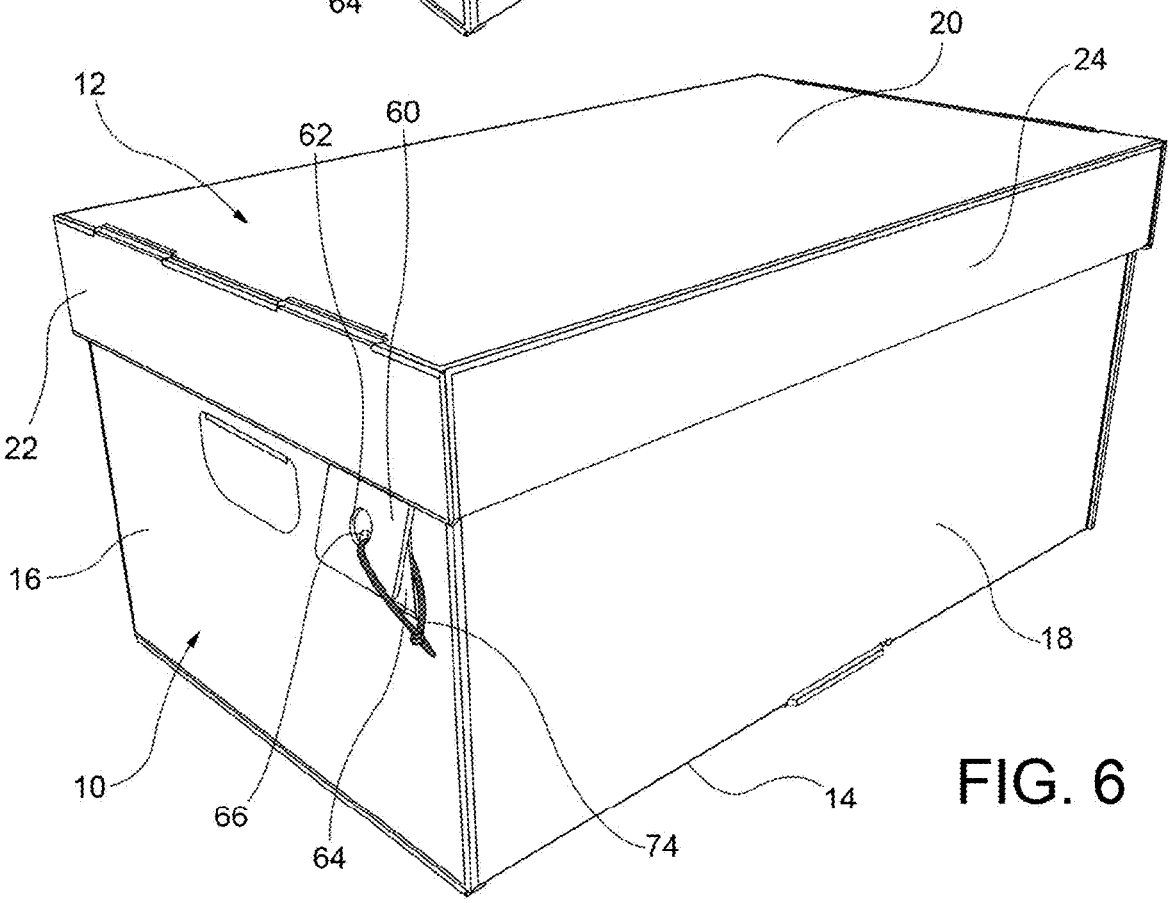

In order to provide the box with tamper evident means, it is not necessary to remove or lift the cover 12, but it is sufficient (see FIGS. 4 to 6) to slightly fold outwards each first tab 60 about the double crease line 52, and each second tab 64 about the crease line 68. In such configuration, it is possible to pass a respective wire-tie 74 through the through-holes 62, 66 of the corresponding first and second tabs 60, 64 and then serrate the wire tie 74, so that the first and second tabs 60, 64 of each couple are bound together. The tabs 60, 64 can then be returned into the normal configuration in which the tabs 60, 64 of each couple are facing to each other.

In order to lift the cover 12 and be able to open the box, it is now necessary to open or break the wire ties 74, so that evidence of the opening remains and any tampering is immediately apparent.

On the other hand, if there is no need of providing tamper evident means, the box has a general structure and functionality corresponding to the ones of a conventional box and can be used in the same way.

The principles of the invention remaining unchanged, embodiments and constructional details may be modified with respect to those described purely by way of example, without thereby departing from the scope of protection as described and claimed herein. For example, the first and second tabs might be provided on the long sides of the box and the general structure of this latter might be different, in particular not providing for double-panel side walls. Also, the shape of the tabs and the through-holes thereof, as well the reciprocal arrangement of each couple of first and second tabs might be any, with the proviso that it is allowed the passage therethrough of the wire-tie or other tamper evident means.

What is claimed is:

1. A box consisting of a monolithic lower container, a monolithic cover, and tamper evident means, wherein the monolithic lower container has a rectangular bottom wall, two first side walls opposite to each other and two second side walls opposite to each other, wherein the monolithic cover has a rectangular main wall opposite to said rectangular bottom wall, two third side walls opposite to each other and two fourth side walls opposite to each other, the third side walls being adjacent and outside an upper portion of said first side walls, respectively, and the fourth side walls being adjacent and outside an upper portion of said second side walls, respectively, wherein a respective first tab with a through-hole protrudes downwards from a lower edge of both third side walls, a respective second tab with a through-hole is cut out from, and formed in, each first side wall, thereby forming a cut-out portion in each first side wall, and the tamper evident means pass through respective couples of first and second tabs of adjacent third and first walls, and wherein each respective second tab is rectangular and has a crease line formed below the cut-out portion of the corresponding first side wall.

2. The box of claim 1, wherein said tamper evident means are constituted by a respective wire-tie passing through at least partially aligned through-holes of each couple of first and second tabs.

3. The box of claim 1, wherein the first tabs have an upper side attached by a double crease line to an edge of the respective third side wall.

4. The box of claim 3, wherein said through-holes are circular, have a same diameter and are cut in a center portion of said first and second tabs, so that the through-holes of the couples of adjacent first and second tabs are fully aligned.

5. The box of claim 1, wherein the couples of first and second tabs of adjacent third and first walls are oppositely located in respect of a median region of the box.

6. The box of claim 1, wherein each of said first side walls is formed by an external panel and an internal panel attached to each other by a first crease line, wherein said second tabs are cut within the respective external panel.

7. The box of claim 6, wherein each of said internal panels has an opening for box handling and each of said external panels has a foldable tongue aligned to a corresponding opening and has a same shape as the corresponding opening.

8. The box of claim 1, wherein each of said third side walls is formed by an external flap and an internal flap attached to each other by a double crease line, wherein said first tabs are cut within the respective internal flap and protrude from the respective external flap.

9. The box of claim 1, wherein each of said second side walls is formed by an external panel and an internal panel attached to each other by a first crease line.

10. The box of claim 1, wherein said rectangular bottom wall is formed by a bottom panel and a plurality of reinforcing flaps.

* * * * *